US010465441B2

(12) United States Patent
Rupel

(10) Patent No.: US 10,465,441 B2
(45) Date of Patent: Nov. 5, 2019

(54) SEPARATE SHADE COVERINGS FOR BLINDS

(71) Applicant: Hunter Douglas, Inc., Pearl River, NY (US)

(72) Inventor: John D. Rupel, Pine River, WI (US)

(73) Assignee: Hunter Douglas Inc., Pearl River, NY (US)

( * ) Notice: Subject to any disclaimer, the term of this patent is extended or adjusted under 35 U.S.C. 154(b) by 293 days.

(21) Appl. No.: 15/362,176

(22) Filed: Nov. 28, 2016

(65) Prior Publication Data

US 2017/0074036 A1 Mar. 16, 2017

Related U.S. Application Data

(62) Division of application No. 14/723,843, filed on May 28, 2015, now Pat. No. 9,506,289.

(60) Provisional application No. 62/004,310, filed on May 29, 2014.

(51) Int. Cl.

| | |
|---|---|
| ***E06B 9/264*** | (2006.01) |
| ***E06B 9/38*** | (2006.01) |
| ***E06B 9/28*** | (2006.01) |
| ***E06B 9/262*** | (2006.01) |
| ***E06B 9/303*** | (2006.01) |
| ***E06B 9/386*** | (2006.01) |
| *E06B 9/24* | (2006.01) |

(52) U.S. Cl.

CPC ..... *E06B 9/264* (2013.01); *E06B 9/262* (2013.01); *E06B 9/28* (2013.01); *E06B 9/303* (2013.01); *E06B 9/38* (2013.01); *E06B 9/386* (2013.01); *E06B 2009/2405* (2013.01); *E06B 2009/2625* (2013.01)

(58) Field of Classification Search

CPC ..... E06B 9/264; E06B 9/386; E06B 9/262; E06B 9/38; E06B 9/303; E06B 9/28; E06B 2009/2625

See application file for complete search history.

(56) References Cited

U.S. PATENT DOCUMENTS 2,091,579 A 8/1937 Balthasar
2,152,117 A * 3/1939 Wade ..... E06B 9/388 160/168.1 R (Continued)

FOREIGN PATENT DOCUMENTS

CA 2391703 11/2003
CN 2545343 Y 4/2003

(Continued)

*Primary Examiner* — Katherine W Mitchell
*Assistant Examiner* — Abe Massad
(74) *Attorney, Agent, or Firm* — Dority & Manning, P.A.

(57) ABSTRACT

A shade covering for a blind having a plurality of horizontal slats and at least one cord ladder configured to support the slats may generally include a plurality of attachment portions configured to be spaced apart from one another along a first direction of the shade covering. Each attachment portion may define an insertion slit. The shade covering may also include a plurality of shade portions extending between each adjacent pair of attachment portions. Moreover, the insertion slit may be defined through a rear end of each attachment portion such that an insertion end of the insertion slit is open at the rear end.

24 Claims, 11 Drawing Sheets

(56) References Cited

U.S. PATENT DOCUMENTS

| | | | | |
|---|---|---|---|---|
| 2,254,705 | A * | 9/1941 | Morse | E06B 9/384 160/173 R |
| 2,311,716 | A * | 2/1943 | Walker | E06B 9/382 160/168.1 R |
| 2,513,895 | A | 7/1950 | Seagaard | |
| 2,523,038 | A | 9/1950 | Mayer | |
| 2,570,608 | A * | 10/1951 | Spiegel | E06B 9/384 160/178.3 |
| 3,490,515 | A * | 1/1970 | Walter | E06B 9/386 160/178.1 R |
| 5,375,642 | A | 12/1994 | Gaber et al. | |
| 5,409,050 | A | 4/1995 | Hong | |
| 5,603,369 | A | 2/1997 | Colson et al. | |
| 5,845,690 | A | 12/1998 | Colson et al. | |
| 6,068,039 | A | 5/2000 | Judkins | |
| 6,405,783 | B1 | 6/2002 | Smith | |
| 6,648,048 | B2 | 11/2003 | Lai | |
| 6,675,859 | B2 | 1/2004 | Nien | |
| 6,688,373 | B2 | 2/2004 | Corey et al. | |
| 6,799,624 | B2 | 10/2004 | Smith | |
| 6,834,702 | B2 | 12/2004 | Nien | |
| 7,124,802 | B2 | 10/2006 | Sudano | |
| 7,556,080 | B2 | 7/2009 | Nien | |
| 2001/0001405 | A1 * | 5/2001 | Rupel | E06B 9/262 156/73.1 |
| 2003/0192650 | A1 | 10/2003 | Nien | |
| 2008/0223530 | A1 | 9/2008 | Grosso | |
| 2009/0139664 | A1 | 6/2009 | Graichen | |
| 2012/0048479 | A1 | 3/2012 | Robertson | |

FOREIGN PATENT DOCUMENTS

| | | |
|---|---|---|
| EP | 1325999 | 7/2003 |
| EP | 1375814 | 1/2004 |
| EP | 1375815 | 1/2004 |
| EP | 1479867 | 11/2004 |
| JP | 3762718 | 1/2006 |

* cited by examiner

SEPARATE SHADE COVERINGS FOR BLINDS

This application is a divisional of and claims the benefit of priority to U.S. patent application Ser. No. 14/723,843, filed May 28, 2015, which, in turn, is based upon and claims the benefit of priority to U.S. Provisional Patent Application No. 62/004,310, filed May 29, 2014, the disclosures of both of which are hereby incorporated by reference herein their entirety for all purposes.

FIELD OF THE INVENTION

The present subject matter relates generally to blind assemblies for architectural openings and, more particularly, to a separate shade covering for a blind.

BACKGROUND OF THE INVENTION

Blinds, such as venetian blinds, traditionally include two or more sets of slat supports in the form of ladders, with each ladder having first and second vertically extending ladder cords and a plurality of vertically spaced rungs extending between the cords. Horizontal slats are typically positioned over the rungs to allow the slats to be vertically supported by the ladders. To tilt the slats, a suitable tilting means, such as tilt cords or a tilt roll, may be coupled to the ladder cords in a manner that allows the slats to be rotated between open and closed positions by manipulating the cords. Additionally, a lift cord typically extends through the slats and is attached at its lower end to a bottom rail so that the lift cord may be used to raise the bottom rail as well as the slats.

Such blinds are well equipped to allow one to effectively adjust the amount of light entering a room. However, from an aesthetic point of view, there is little facility for variation of the general appearance of the blinds.

Accordingly, a shade covering that may be separately attached onto an existing or new blind to enhance the aesthetic appearance thereof would be welcomed in the technology.

BRIEF DESCRIPTION OF THE INVENTION

Aspects and advantages of the invention will be set forth in part in the following description, or may be obvious from the description, or may be learned through practice of the invention.

In one aspect, the present subject matter is directed to a blind assembly for an architectural opening. The blind assembly may generally include a blind having a plurality of slats and at least one cord ladder configured to support the slats. The cord ladder(s) may include a front ladder run, a rear ladder run, and a plurality of support rungs extending between the front and rear ladder runs. The front ladder run may extend along a front side of the blind and the rear ladder run may extend along a rear side of the blind. The blind assembly may also include a separate shade covering configured to be secured to the blind such that the shade covering extends along the front side of the blind. The shade covering may include a plurality of attachment portions and a plurality of shade portions. Each attachment portion may define an insertion slit. Each shade portion may be configured to extend between each adjacent pair of attachment portions. Moreover, the insertion slit may be defined through a rear end of each attachment portion such that an insertion end of the insertion slit is open at the rear end for receiving the front ladder run when the shade covering is installed onto the blind.

In another aspect, the present subject matter is directed to a shade covering for a blind, wherein the blind includes a plurality of slats and at least one cord ladder configured to support the slats. The shade covering may generally include a plurality of attachment portions configured to be spaced apart from one another along a first direction of the shade covering. Each attachment portion may define an insertion slit. The shade covering may also include a plurality of shade portions extending between each adjacent pair of attachment portions. Moreover, the insertion slit may be defined through a rear end of each attachment portion such that an insertion end of the insertion slit is open at the rear end.

These and other features, aspects, and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures, in which.

DETAILED DESCRIPTION OF THE INVENTION

Figure 1:
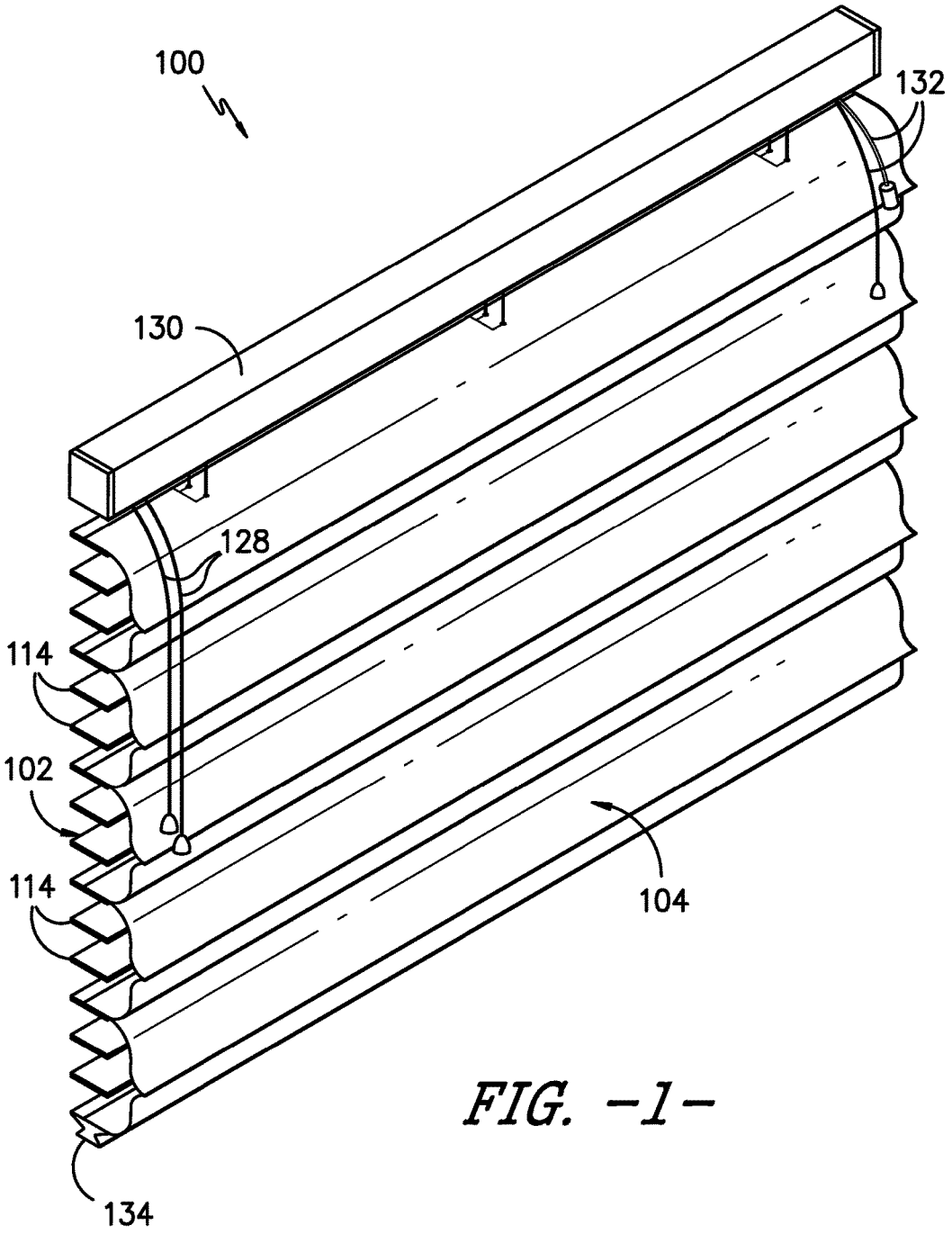
FIG. 1 illustrates a perspective view of one embodiment of a blind assembly in accordance with aspects of the present subject matter.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

In general, the present subject matter is directed to a blind assembly that can be mounted or otherwise positioned in and/or relative to an architectural opening, such as a window or door, for blocking light, providing privacy, increasing the aesthetic appeal of a room, and/or allowing a desired amount of light into a room. Specifically, in several embodiments, the blind assembly may include a blind and a shade covering configured to be separately attached to the blind. For example, the shade covering may be configured to be secured to the blind such that the covering generally extends along a front face or side of the blind. As such, the shade covering may provide an aesthetically pleasing facade for the side of the blind facing the interior of the room within which the blind assembly is installed. Moreover, the addition of the shade covering may also provide for a more uniform transmission of light through the blind assembly as opposed to the use of the blind by itself.

In several embodiments, the disclosed shade covering may be configured to be coupled to one or more cords of the corresponding blind as opposed to the vanes or slats of the blind. For instance, the shade covering may define one or more insertion slits configured to receive one or more of the various cords (e.g., one or more of the ladder runs and/or the lift cord) of the blind onto which the shade covering is installed. Specifically, as will be described below, the insertion slit(s) may be defined in the shade covering to be open or accessible at a rear end of the covering. As such, to couple the shade covering to the blind, the shade covering may be moved relative to the blind from the blind's front side to the blind's rear side such that the cord(s) of the blind are received within the insertion slit(s) at the rear end of the shade covering.

Moreover, in several embodiments, the shade covering may also include one or more additional attachment features to further assist in coupling the shade covering to the blind. Specifically, in one embodiment, the shade covering may include one or more attachment slits extending from each insertion slit, with each attachment slit being configured to receive one of the cords of the blind. For instance, as will be described below, the attachment slit(s) may be configured to extend in a direction that is transverse from the lengthwise direction of the insertion slit(s) such that the shade covering must be moved in a first direction to allow the cord(s) to be received within the insertion slit(s) and in a second, perpendicular direction to allow the cord(s) to be received within the attachment slit(s). Additionally, in one embodiment, the shade covering may also include an attachment opening provided in operative association with each attachment slit to further assist in coupling the shade covering to the blind. As will be described below, each attachment opening may also define a cross-wise dimension that is greater than its corresponding attachment slit to accommodate variations in the lateral widths defined between the cords of the blind.

In other embodiments, the blind assembly may include any other suitable component(s) and/or may have any other suitable configuration to assist in coupling the shade covering to the blind. For instance, in one embodiment, the blind assembly may include one or more fasteners or clips configured to assist in coupling the shade covering to the blind. In another embodiment, an adhesive(s) and/or any other suitable attachment means may be utilized to assist in coupling the shade covering to the blind.

Additionally, it should be appreciated that, since the disclosed shade covering is configured to be separately attached to a blind, the shade covering may be retrofitted onto existing blinds, thereby allowing for after-market installation. As such, the shade covering may be manufactured, advertised, and/or sold as a stand-alone component. Alternatively, the shade covering may be offered as an add-on feature to be included with the purchase of new blinds. In addition, given the ease in which the disclosed shade covering may be installed onto and/or removed from a blind, a given shade covering may be quickly and easily replaced with a different shade covering and/or removed to allow the shade covering to be washed. In such instance, the shade covering may, in one embodiment, be machine-washable. Moreover, the manner in which the disclosed shade covering is configured to be coupled to its corresponding blind may allow the shade covering to be installed onto and/or removed from the blind without damaging and/or marking the blind's slats.

Further, it should be appreciated that the blind included within the disclosed blind assembly may be configured to function as usual regardless of whether the shade covering is installed thereon. For instance, with the shade covering installed, the blind may still be moved between its extended and retracted positions to cover and uncover, respectively, the architectural opening within which the blind is installed. In addition, with the shade covering installed, the slats of the blind may still be rotatable or tiltable about their longitudinal axes to allow the slats to be moved between their open and closed positions.

Figure 2:
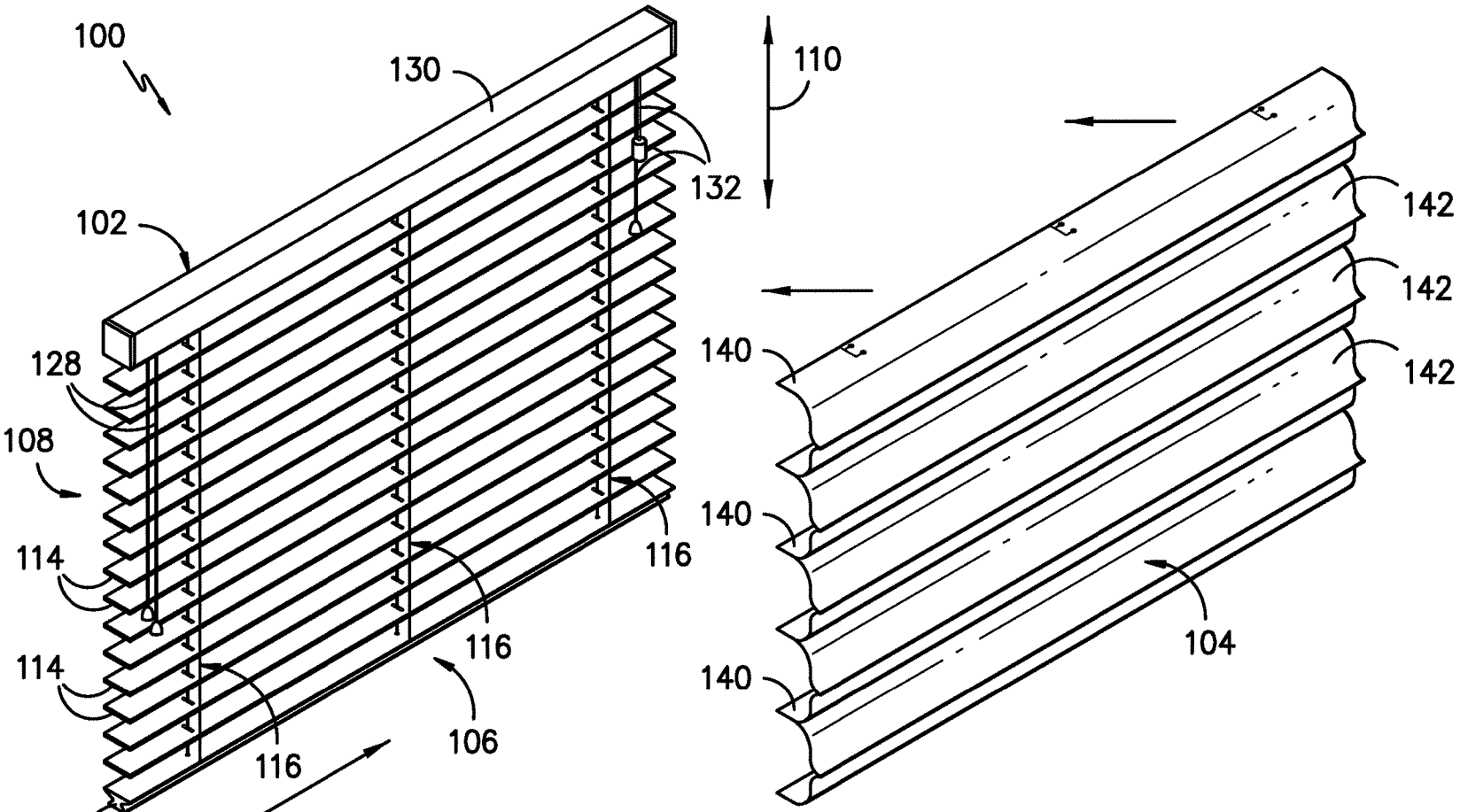
FIG. 2 illustrates an exploded view of the blind assembly shown in FIG. 1, particularly illustrating a shade covering of the assembly exploded away from a blind of the assembly.
Figure 3:
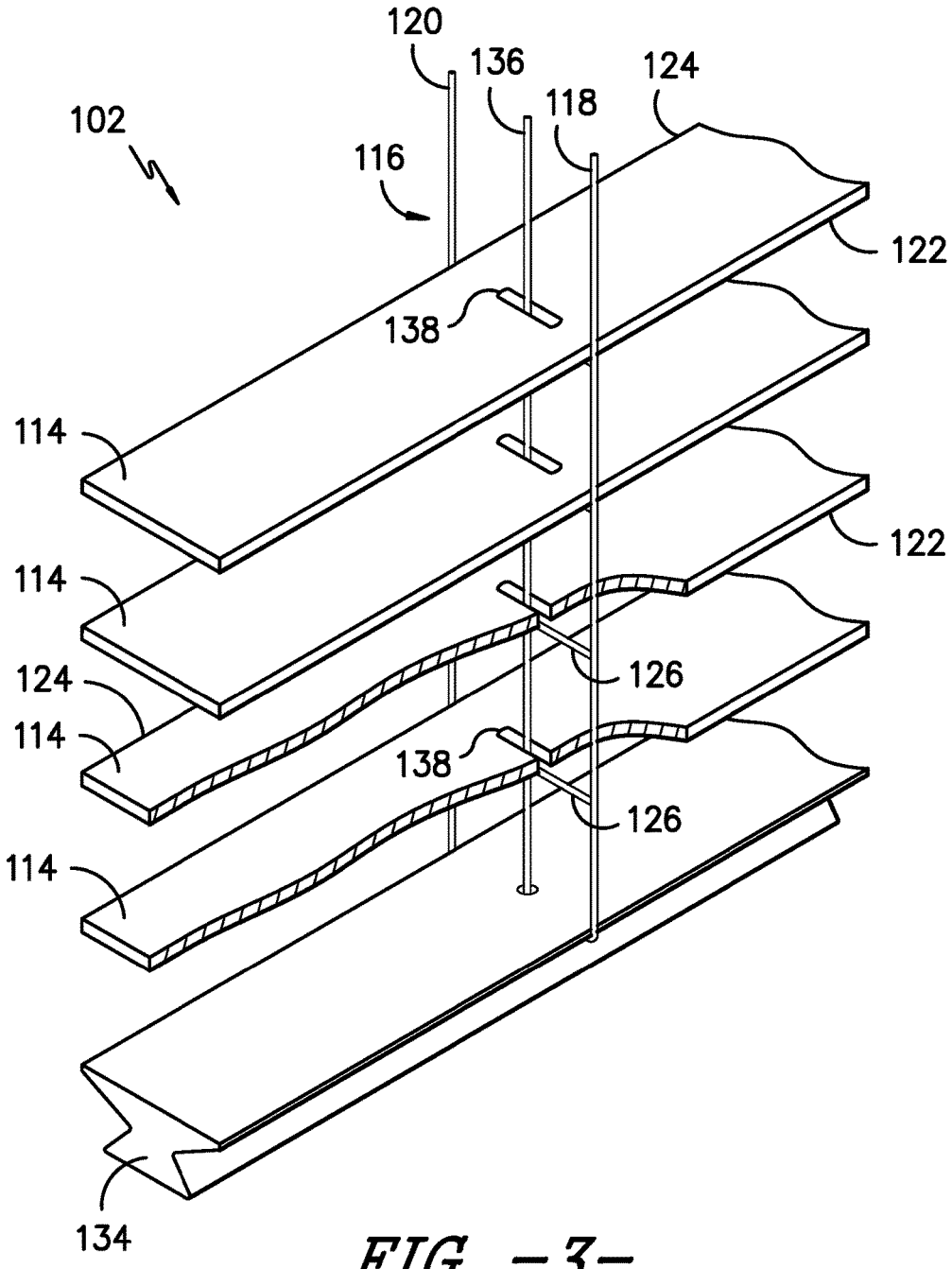
FIG. 3 illustrates a perspective, cut-way view of a portion of the blind shown in FIG. 2.
Figure 4:
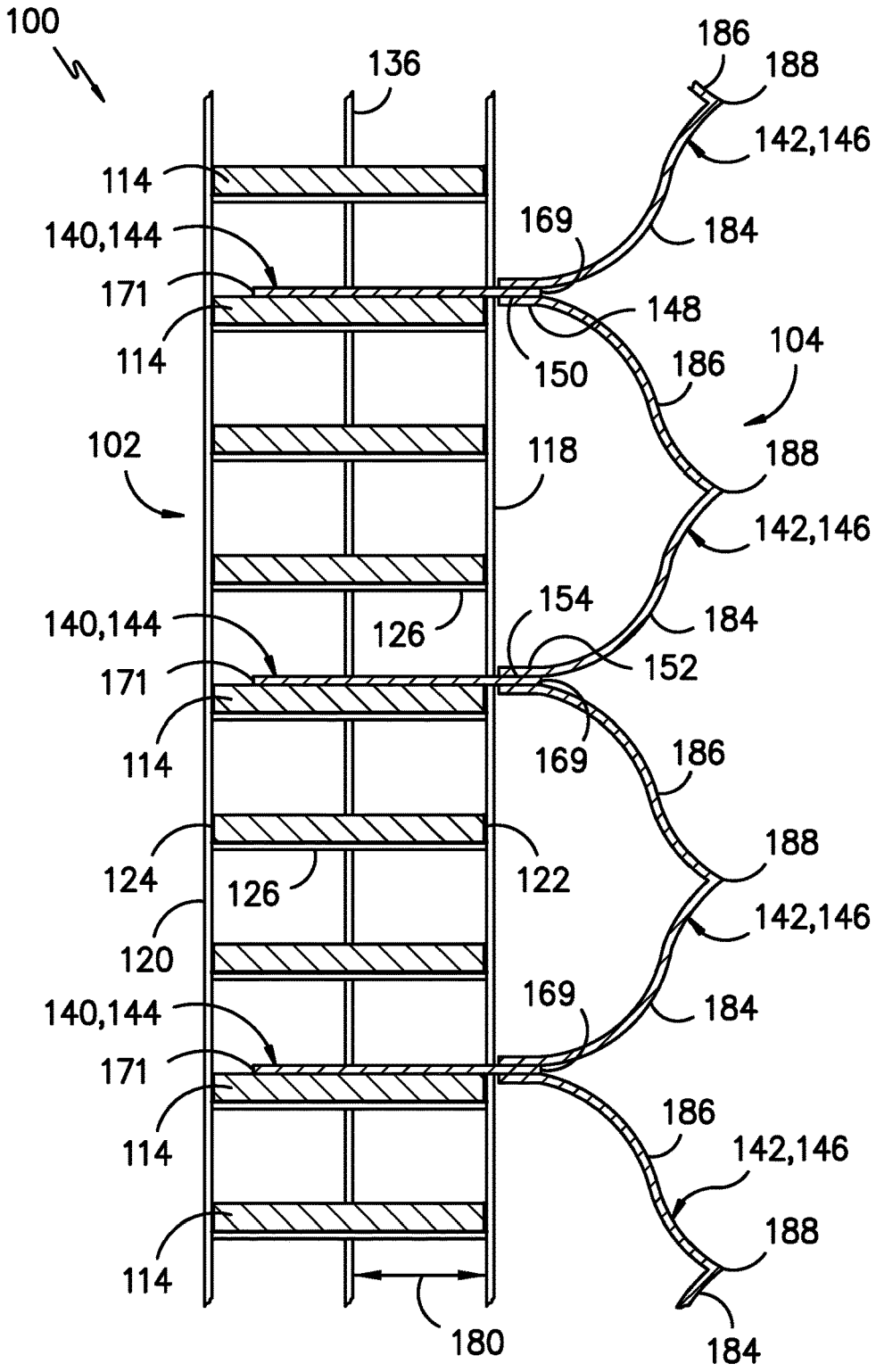
FIG. 4 illustrates a partial, cross-sectional view of the blind assembly shown in FIG. 1 taken about line 4-4.
Figure 5:
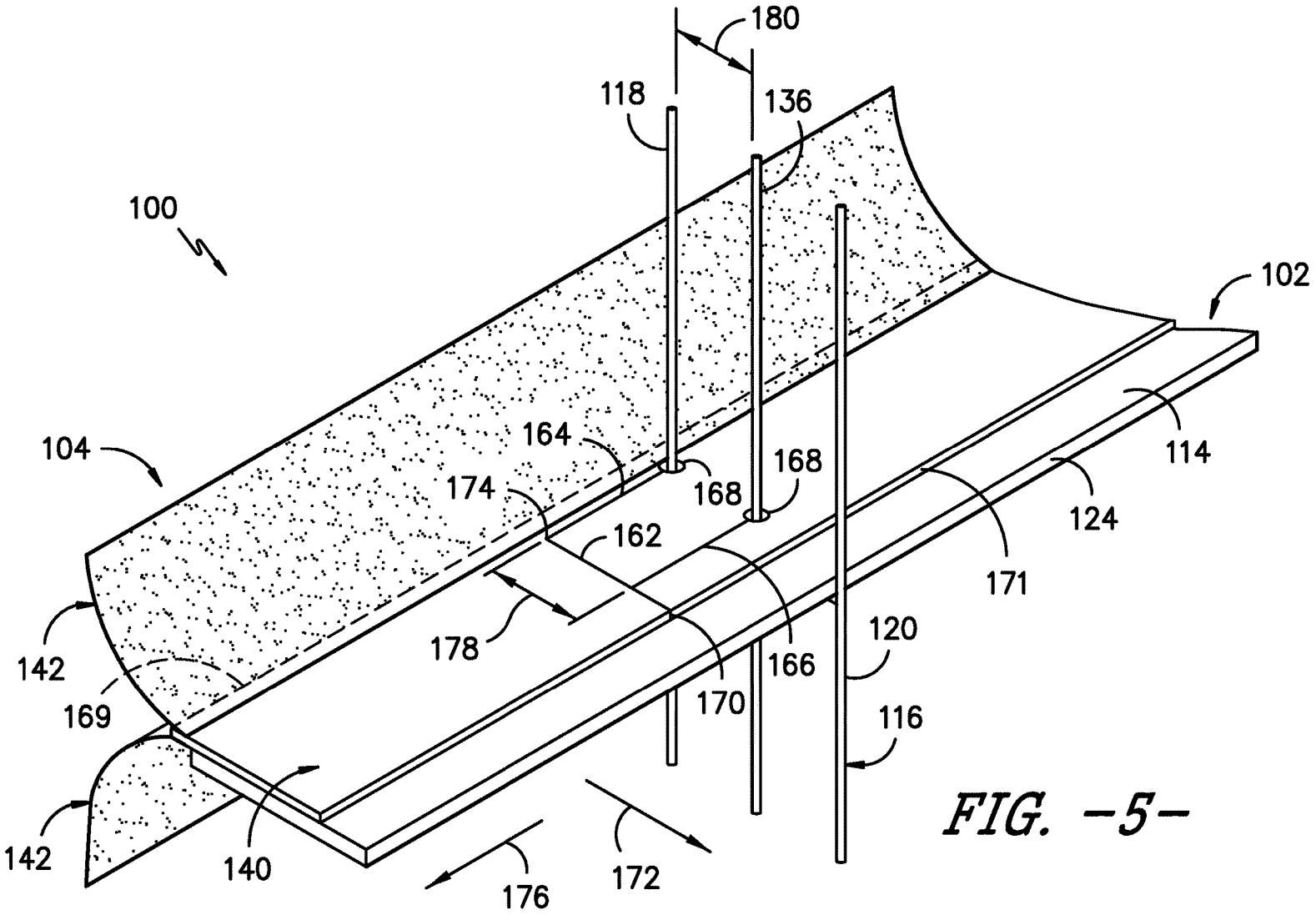
FIG. 5 illustrates a rear perspective view of a portion of the blind assembly shown in FIG. 1, particularly illustrating a method for attaching the shade covering to the blind.

Referring now to the drawings, FIGS. 1-5 illustrate differing views of one embodiment of a blind assembly 100 in accordance with aspects of the present subject matter. Specifically, FIGS. 1 and 2 illustrate front perspective and exploded views of the blind assembly 100, respectively, with FIG. 2 particularly illustrating a blind 102 of the assembly 100 and a shade covering 104 of the assembly 100 exploded away from the blind 102. FIG. 3 illustrates a partial, perspective view of the blind 102 shown in FIG. 2, with portions of the blind 102 being cut-away or removed for illustrative purposes. FIG. 4 illustrates a cross-sectional side view of a portion of the blind assembly 100 shown in FIG. 1 taken about line 4-4. Additionally, FIG. 5 illustrates a rear perspective view of a portion of the blind assembly 100 shown in FIG. 1, particularly illustrating one embodiment of a manner in which the shade covering 104 may be secured to the blind 102.

As shown in FIGS. 1-5, the blind assembly 100 may generally include a blind 102 and a separate shade covering 104 configured to be secured to the blind 102. In several embodiments, the blind 102 may correspond to a horizontal blind. In such embodiments, the blind 102 may generally have any suitable configuration known in the art that provides a horizontal-type covering for an architectural opening, such as a window, door, and/or the like. For instance, as shown in the illustrated embodiment, the blind 102 is configured as a venetian-blind-type extendable/retractable covering. As such, the blind 102 may be movable between an extended position (e.g., as shown in FIGS. 1 and 2) and a retracted position (not shown). When extended, the blind 102 may define a front face or side 106 and a rear face or side 108 configured to extend both in a heightwise direction (indicated by arrow 110 in FIG. 2) a given distance (e.g., any distance along the height of the architectural opening within which the blind 102 is installed) and in a widthwise direction (indicated by arrow 112 in FIG. 2) a given distance (e.g., a distance corresponding to the width of the architectural opening within which the blind 102 is installed). It should be appreciated that the terms "front" and "rear" are generally used herein simply to distinguish opposite faces or sides of the blind 102, itself, and/or to distinguish opposite faces or sides of other components or features of the disclosed blind assembly 100. However, for purposes of description, the front side 106 will be described herein as corresponding to the side of the blind 102 designed to face towards the interior of the room within which the blind assembly 100 is installed.

It should be appreciated that, although the disclosed shade covering 104 will generally be described herein as being configured for use with a horizontal blind (e.g., a blind configured to be extended and retracted in the vertical direction, such as by using a lift cord or other suitable device), the shade covering 104 may also be configured for use with a vertical blind (e.g., a blind configured to be extended and retracted in the horizontal direction, such as by using a vertical blind tract or other suitable device).

As particularly shown in FIG. 2, the blind 102 may include a plurality of horizontally disposed parallel slats 114 configured to be vertically supported via one or more cord ladders 116. Each cord ladder 116 may include a front ladder run 118 extending vertically adjacent to a front edge 122 (FIG. 3) of each of the slats 114 along the front side 106 of the blind 102, a rear ladder run 120 extending vertically adjacent to a rear edge 124 (FIG. 4) of each of the slats 114 along the rear side 108 of the blind 102, and a plurality of support rungs 126 (FIGS. 3 and 4) interconnecting the front and rear ladders runs 118, 120 at equally spaced intervals for vertically supporting the slats 114. As is generally understood, the slats 114 may be rotatable or tiltable about their longitudinal axes by manipulating the front and rear ladders runs 118, 120 to allow the slats 114 to be moved between an open position (e.g., as shown in FIGS. 1 and 2) for permitting light to pass between the slats 114 and a closed position (not shown), wherein the slats 114 are substantially vertically oriented in an overlapping manner to occlude or block the passage of light through the blind 102. Such manipulation of the ladder runs 118, 120 may be achieved, for example, using a suitable tilt roll or tilt cords 128 (FIG. 2) forming part of a control system (not shown) disposed within a head rail 130 associated with the blind 102. It should be appreciated that, in accordance with aspects of the present subject matter, the ability to rotate or tilt the slats 114 about their longitudinal axes may remain intact when the disclosed shade covering 104 is installed onto the blind 102.

The blind 102 may also include a lift system associated therewith having control cords 132 (FIG. 2) for moving the blind 102 between an extended position and a retracted position. For instance, as shown in the illustrated embodiments, the control cords 132 may be used to raise or lower a bottom rail 134 of the blind 102 (e.g., positioned at an opposite end of the blind 102 relative to the head rail 130) via lift cords to move the blind 102 between the extended position (e.g., as shown in FIGS. 1 and 2), wherein the bottom rail 134 is spaced apart from the head rail 130, and the retracted position, wherein the bottom rail 134 is positioned adjacent to the head rail 130 with the slats 114 being stacked vertically therebetween. As is generally understood, an upper end of the control cords 136 may be associated with a cord lock or similar locking mechanism disposed within or adjacent to the head rail 130 to allow the blind 102 to be locked in place vertically. As particularly shown in the illustrated embodiment, the lift cords 136 may be configured to extend through each slat 114, such as by extending vertically through openings 138 defined between the front and rear edges 122, 124 of each slat 114. However, in other embodiments, the lift cords 136 may be configured to extend vertically between the head rail 130 and the bottom rail 134 at any other suitable location relative to the slats 114. It should be appreciated that, in accordance with aspects of the present subject matter, the ability to raise and lower the blind 102 between its retracted and extended positions may remain intact when the disclosed shade covering 104 is installed onto the blind 102.

As indicated above, the blind assembly 100 may also include a shade covering 104 configured to be separately attached to the blind 102. Specifically, in several embodiments, the shade covering 104 may be configured to be attached to the blind 102 such that the shade covering 104 extends along the front face or side 106 of the blind 100. As such, the shade covering 104 may be used to provide an aesthetically pleasing façade along the front side 106 of the blind 100. In addition, the shade covering 104 may also be used to provide for more uniform light transmission through the blind assembly 100 along the heightwise direction 110 when the slats 114 are tilted or moved to the open position.

In general, the shade covering 104 may include a plurality of attachment portions 140 configured to be secured to the blind 102 and a plurality of shade portions 142 arranged in an alternating manner along the length of the covering 104. In one embodiment, the attachment portions 140 may be configured to be secured to the blind 102 such that each attachment portion 140 is positioned adjacent to and/or is vertically supported by one of the slats 114. For instance, as shown in FIG. 4, when the shade covering 104 is installed onto the blind 102, each attachment portion 140 may be supported along a top side of one of the slots 114 across at least a portion of the width defined between a front end 169 and a rear end 171 of the attachment portion 140. Additionally, each shade portion 142 may be configured to extend outwardly and/or vertically between each pair of adjacent attachment portions 140 along the front side 106 of the blind 102 to provide the appearance of a continuous shade extending vertically along the height of the blind 102.

In several embodiments, the attachment portions 140 and the shade portions 142 of the disclosed shade covering 104 may be formed from separate webs configured to be coupled to one another to form the shade covering 104. For instance, as particularly shown in FIG. 4, in one embodiment, the attachment portions 140 may be formed from a plurality of first webs 144 and the shade portions may be formed from a plurality of separate, second webs 146. In such an embodiment, the second web 146 forming each shade portion 142 may be configured to be secured to the corresponding first webs 144 forming the attachment portions 140 between which the shade portion 142 extends (e.g., at a location at or adjacent to the front end 169 of each attachment portion 140). For example, as shown in FIG. 4, a top end 148 of each second web 146 may be configured to be secured to a bottom side 150 of the upper attachment portion 140 of each corresponding pair of adjacent attachment portions 140 and a bottom end 152 of each second web 146 may be configured to be secured to a top side 154 of the lower attachment portion 140 of each corresponding pair of adjacent attachment portions 140. It should be appreciated that the separate webs 144, 146 may be secured to one another using any suitable attachment means and/or methodology known in the art, such as by using adhesives and/or by stitching the webs 144, 146 together.

By forming the attachment portions 140 and the shade portions 142 from separate webs 144, 146, the attachment portions 140 may, in several embodiments, be formed from a material that differs from the material used to form the shade portions 142. For instance, in a particular embodiment, it may be desirable to form the attachment portions 140 from a stiffer material than the material used to form the shade portions 142, which may allow for an enhanced connection between the attachment portions 140 and the blind 102 and/or provide additional support for the shade covering 104 along the top sides of the slats 114 along which each attachment portion 140 extends. In addition, or as an alternative thereto, the webs 146 forming the shade portions 142 may, for example, be formed from a material having an aesthetically pleasing design or texture. In such an embodiment, since the attachment portions 140 of the shade covering 104 are typically not visible when the covering 104 is secured to the blind 102, the webs 144 forming the attachment portions 140 may be formed from a material that is less ornate and, thus, less expensive, thereby reducing the overall cost of manufacturing the shade covering 104.

Additionally, in several embodiments, the webs 146 forming the shade portions 142 may be formed from a material particularly selected to allow for a desired amount of light transmission through the shade covering 104, thereby providing a light control aspect to the disclosed shade assembly 100. For instance, in one embodiment, the web material may be selected such that a significant portion of the light transmitted through the blind 102 passes through the shade covering 104, such as by using a sheer material to form the shade portions 142. Alternatively, the web material may be selected to block all or a significant portion of the light transmitted through the blind 102, such as by using a black-out material to form the shade portions 142.

Figure 6:
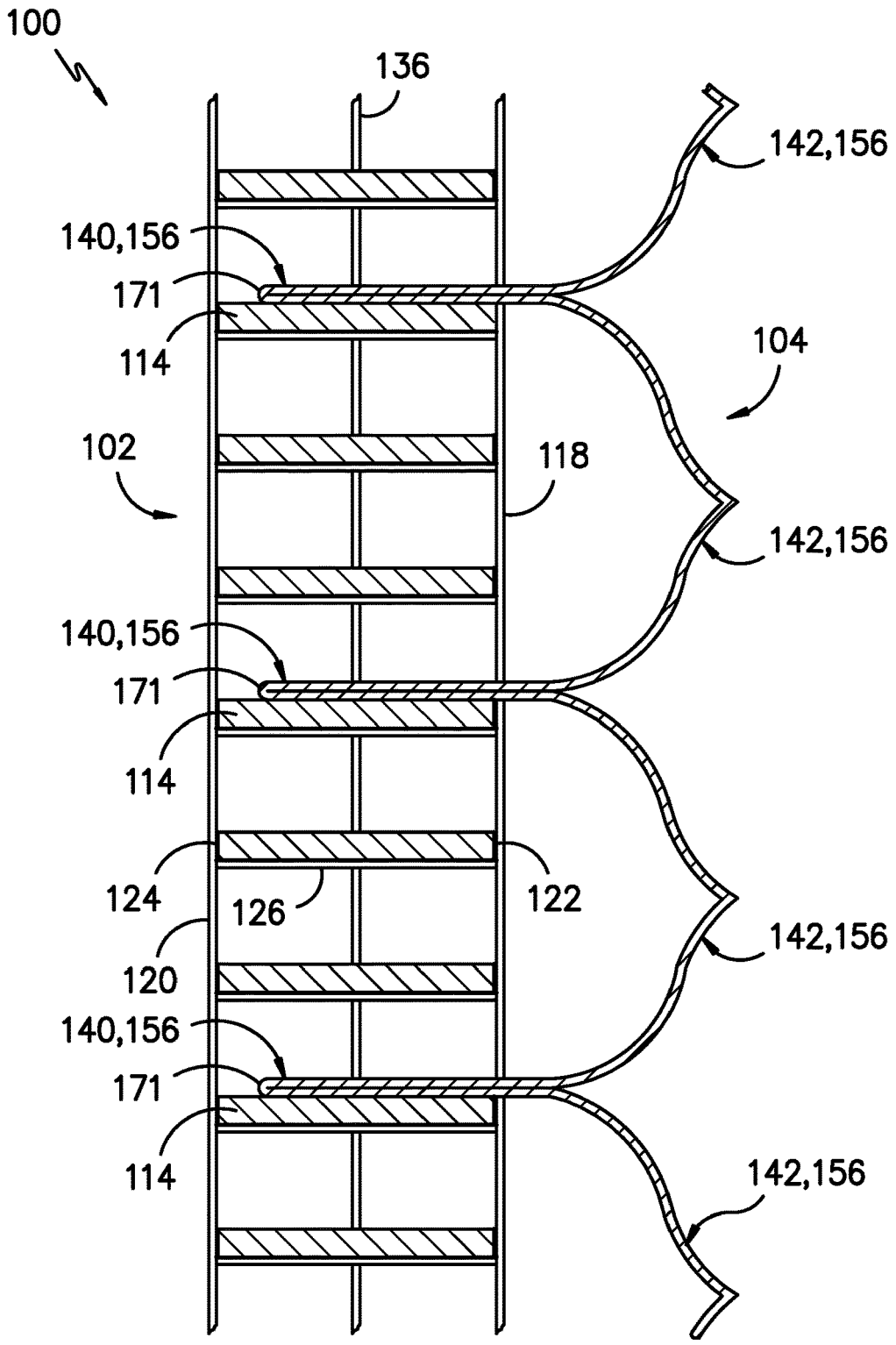
FIG. 6 illustrates a partial, cross-sectional view of another embodiment of a blind assembly in accordance with aspects of the present subject matter, particularly illustrating the shade covering of the assembly being formed from a continuous web.
Figure 7:
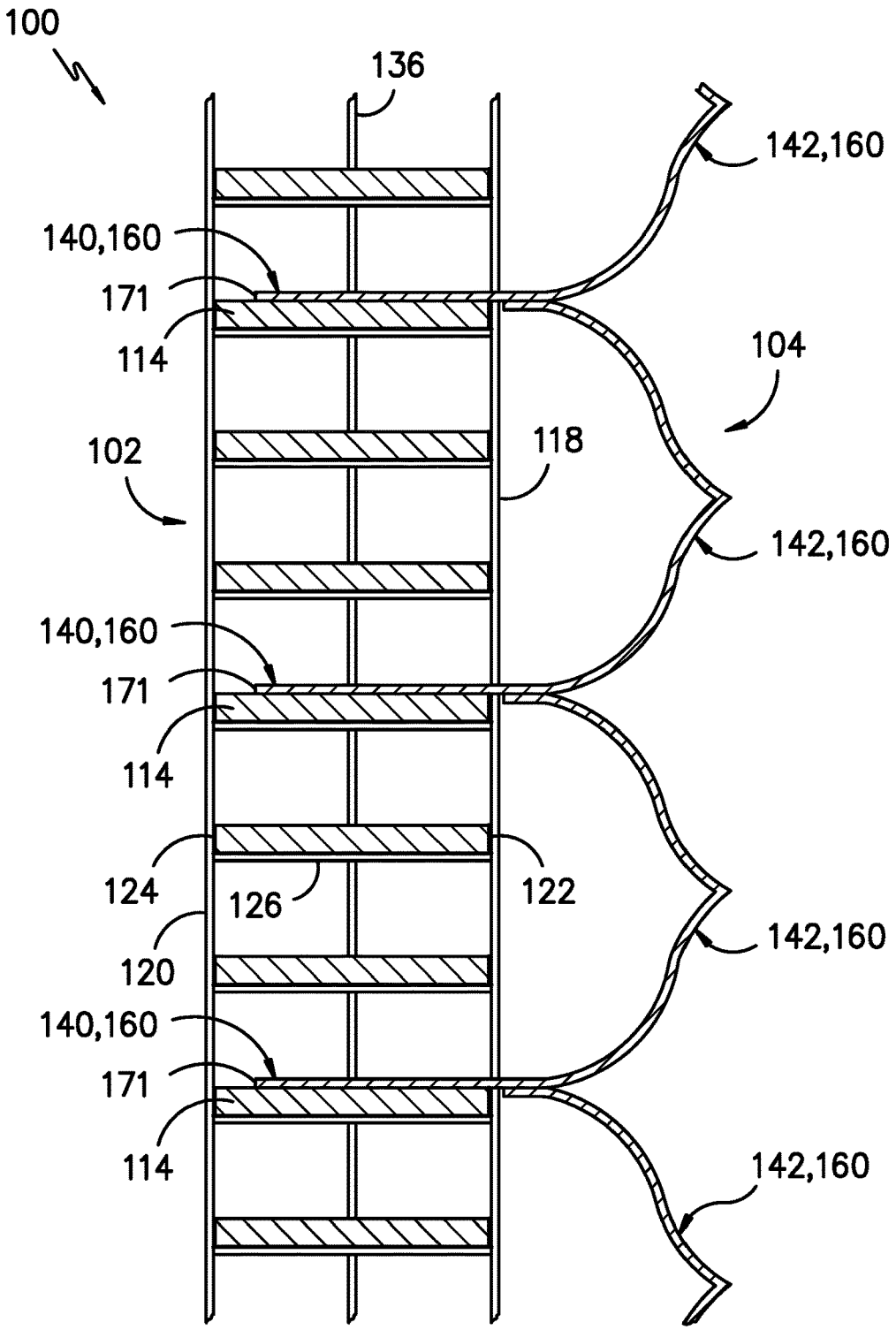
FIG. 7 illustrates a partial, cross-sectional view of a further embodiment of a blind assembly in accordance with aspects of the present subject matter, particularly illustrating sections of the shade covering of the assembly being formed from common webs.

In alternative embodiments, all or sections of the shade covering 104 may be formed from a continuous or common web. For instance, FIG. 6 illustrates a cross-sectional side view of an alternative embodiment of the shade covering 104 in which the entire covering is formed from a continuous web 156. As shown in FIG. 6, in such an embodiment, the web 156 may be looped at the rear end 171 of each attachment portion 140 such that the attachment portions 140 are formed from overlapped sections of the web 156. Similarly, FIG. 7 illustrates a cross-sectional side view of another embodiment of the shade covering 104 in which each shade portion 142 is formed integrally with one of the attachment portions 142 via a common or continuous web 160. As shown in FIG. 7, in such an embodiment, the section of each web 160 forming the shade portion 142 may be secured to the section of the adjacent web 160 forming the adjacent attachment portion 140 to form a continuous shade covering extending vertically along the height of the blind 102.

It should be appreciated that, as used herein, the term "web" generally refers to any material suitable for use within a shade or shade covering, including, but not limited to, woven fabrics, non-woven fabrics, knitted fabrics, films, and/or laminations of any such material(s). In addition, in several embodiments, the webs may be flexible or semi-rigid. A flexible web is formed from a material that is capable of being folded or flexed, such as woven, knitted, or non-woven fabrics; vinyl or film sheets; cords of natural or synthetic fibers; monofilaments; and/or the like. A semi-rigid web, on the other hand, is formed from a material that is somewhat stiffer, but is still flexible or foldable to some degree.

Referring back to FIGS. 1-5, in several embodiments, the attachment portions 140 of the disclosed shade covering 104 may be configured to define one or more attachment features for allowing each attachment portion 140 to be coupled to one or both of the ladder runs 118, 120 of each cord ladder 116 and/or to the lift cords 136 associated with the blind 102. For instance, as shown in the illustrated embodiment, each attachment portion 140 may be configured to define a plurality of slits for receiving the ladder runs 118, 120 and/or the lift cords 136. Specifically, as shown in FIG. 5, each attachment portion 140 may define a plurality of insertion slits 162, with each insertion slit 162 being configured to be aligned with one of the cord ladders 116 when installing the shade covering 104 onto the blind 102. In such an embodiment, to secure each attachment portion 140 to the blind 102, an insertion end 170 of each insertion slot 162 may be initially aligned with the front ladder run 118 of each cord ladder 116. Each attachment portion 140 may then be moved rearward relative to the blind 102 (e.g., in the direction of arrow 172 shown in FIG. 5) until the front ladder run 118 contacts a forward end 174 of the insertion slit 162.

As shown in FIG. 5, it should be appreciated that the insertion slit 162 may be defined in the attachment portion 140 to extend from the rear end 171 of the attachment portion 140 in the direction of the forward end 169 of the attachment portion 140. As such, the insertion end 170 of the insertion slit 162 may be open or accessible at the rear end 171 of the attachment portion 140, thereby allowing the front ladder run 118 to be received within the insertion slit 162 at the insertion end 170 when the attachment portion 140 is moved rearward relative to the blind 102 from the blind's front side 106 towards the blind's rear side 108.

It should also be appreciated that, although the insertion slit 162 is shown in FIG. 5 as extending lengthwise from the rear end 171 of the attachment portion 140 along a straight line oriented generally perpendicular to the rear end 171, the insertion slit 162 may, instead, be configured to extend lengthwise from the rear end 171 along a non-straight line and/or may have any other suitable orientation relative to the rear end 171. For instance, in one embodiment, the insertion slit 162 may extend lengthwise from the rear end 171 along a curved path or a zig-zag path.

Additionally, in one embodiment, each attachment portion 140 may also include first and second attachment slits 164, 166 extending outwardly from each insertion slit 162 to further assist in coupling the shade covering 104 to the blind 102. As shown in FIG. 5, in one embodiment, the attachment slits 164, 166 may be defined in each attachment portion 104 to extend lengthwise generally transverse or perpendicular to the corresponding insertion slit 162. However, in other embodiments, the attachment slits 164, 166 may be oriented at any other suitable angle relative to the insertion slit 162. Moreover, in a particular embodiment of the present subject matter, each attachment slit 164, 166 may terminate in a corresponding attachment opening 168. In such an embodiment, each attachment opening 168 may be configured to further assist in coupling the shade covering 104 to the blind 102.

In the particular embodiment shown in FIG. 5, to secure each attachment portion 140 to the blind 102, the insertion end 170 of each insertion slot 162 may be initially aligned with the front ladder run 118 of each cord ladder 116. Each attachment portion 140 may then be moved rearward relative to the blind 102 (e.g., in the direction of arrow 172 shown in FIG. 5) until the front ladder run 118 contacts the forward end 174 of the insertion slit 162. Thereafter, each attachment portion 140 may be moved horizontally relative to the blind 102 (e.g., in the direction of arrow 176 shown in FIG. 5) such that the front ladder run 118 and the lift cord 136 are received initially within the first and second attachment slits 164, 166, respectively. As shown in FIG. 5, by continuing to move each attachment portion 140 relative to the blind 102 in such direction, the front ladder run 118 and the lift cord 136 may eventually be received within the corresponding attachment openings 168 defined at the end of each attachment slit 164, 166.

It should be appreciated that, given the configuration described above, the attachment slits 164, 166 may generally define a lateral spacing or width 178 that is equal or substantially equal to a lateral width 180 defined between the front ladder run 118 and the lift cord 136. Additionally, it should be appreciated that, in several embodiments, each attachment opening 168 may be configured to define a cross-wise dimension that is greater than its corresponding attachment slit 164, 166. As such, the attachment openings 168 may be configured to accommodate variations in the lateral widths 180 defined between each pair of front ladder rims 118 and corresponding lift cords 136.

Figure 8:
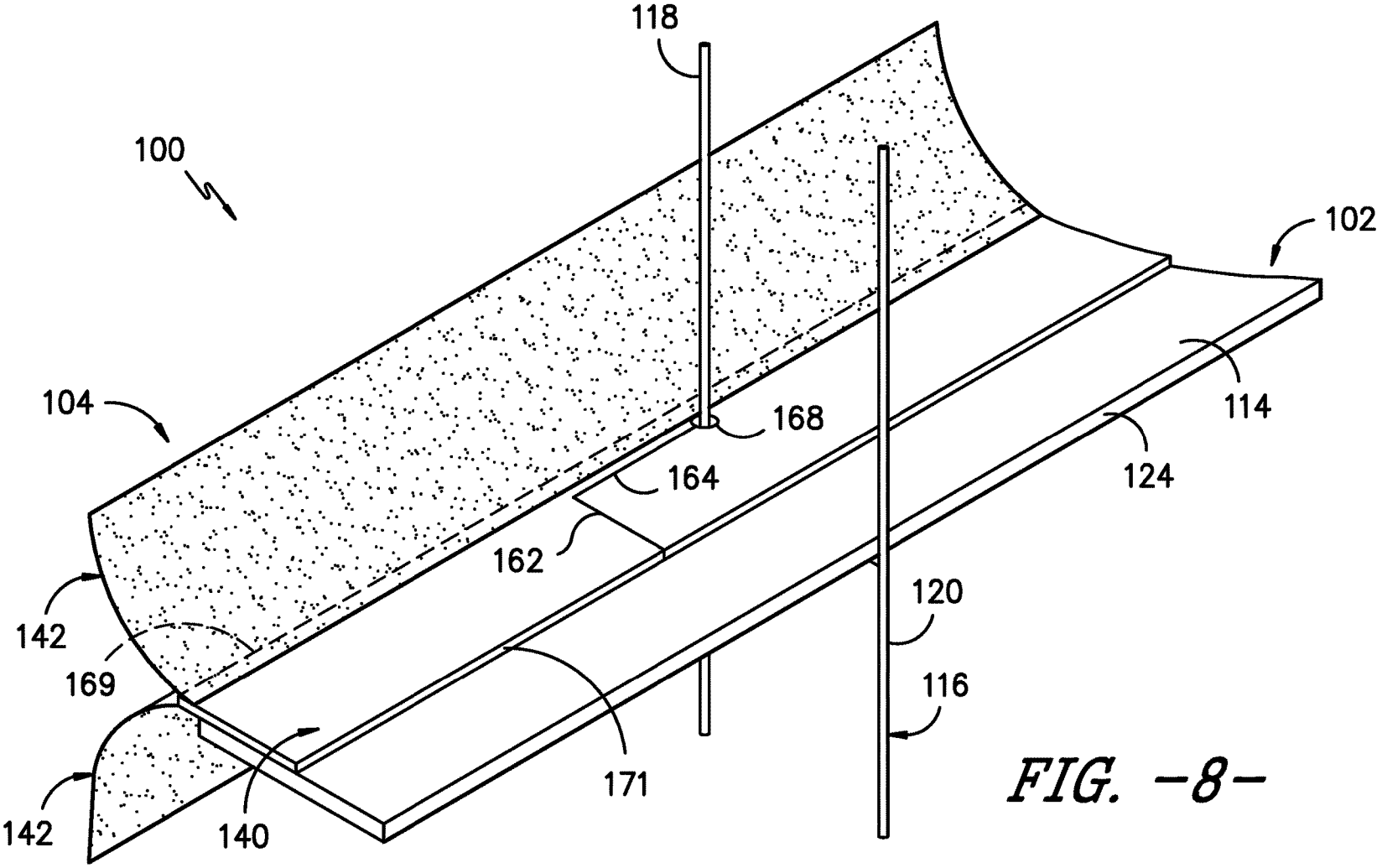
FIG. 8 illustrates a partial, rear perspective view of another embodiment of a blind assembly in accordance with aspects of the present subject matter, particularly illustrating a different method for attaching the shade covering to the blind.

Additionally, it should be appreciated that, in an alternative embodiment, each attachment portion 140 may be configured to define three attachment slits (and, optionally, three corresponding attachment openings) associated with each insertion slit 162 for receiving the front ladder run 118, the lift cord 136 and the rear ladder run 120. In yet another embodiment, each attachment portion 140 may only be configured to define a single attachment slit (and, optionally, a single correspond attachment opening) associated with each insertion slit 162 for simply receiving the front ladder run 118. Such an embodiment may be utilized not only for the blind configuration shown in FIGS. 1-5, but also blind configurations that do not include lift cords 136 extending vertically through the slats 114. For example, FIG. 8 illustrates a partial, rear perspective view of a blind 102 having slats 114 that are not configured to receive corresponding lift cords 136. In such an embodiment, each attachment portion 140 may be configured to define a single attachment slit/opening 164, 168 associated with each insertion slit 162 for receiving the front ladder run 118. Alternatively, still referring to the configuration of FIG. 8, each attachment portion 140 may, instead, be configured to define two attachment slits/openings for receiving both the front ladder run 118 and the rear ladder run 120. In such an embodiment, the lateral width defined between the attachment slits may generally correspond to the lateral width defined between the ladder runs 118, 120.

Figure 9:
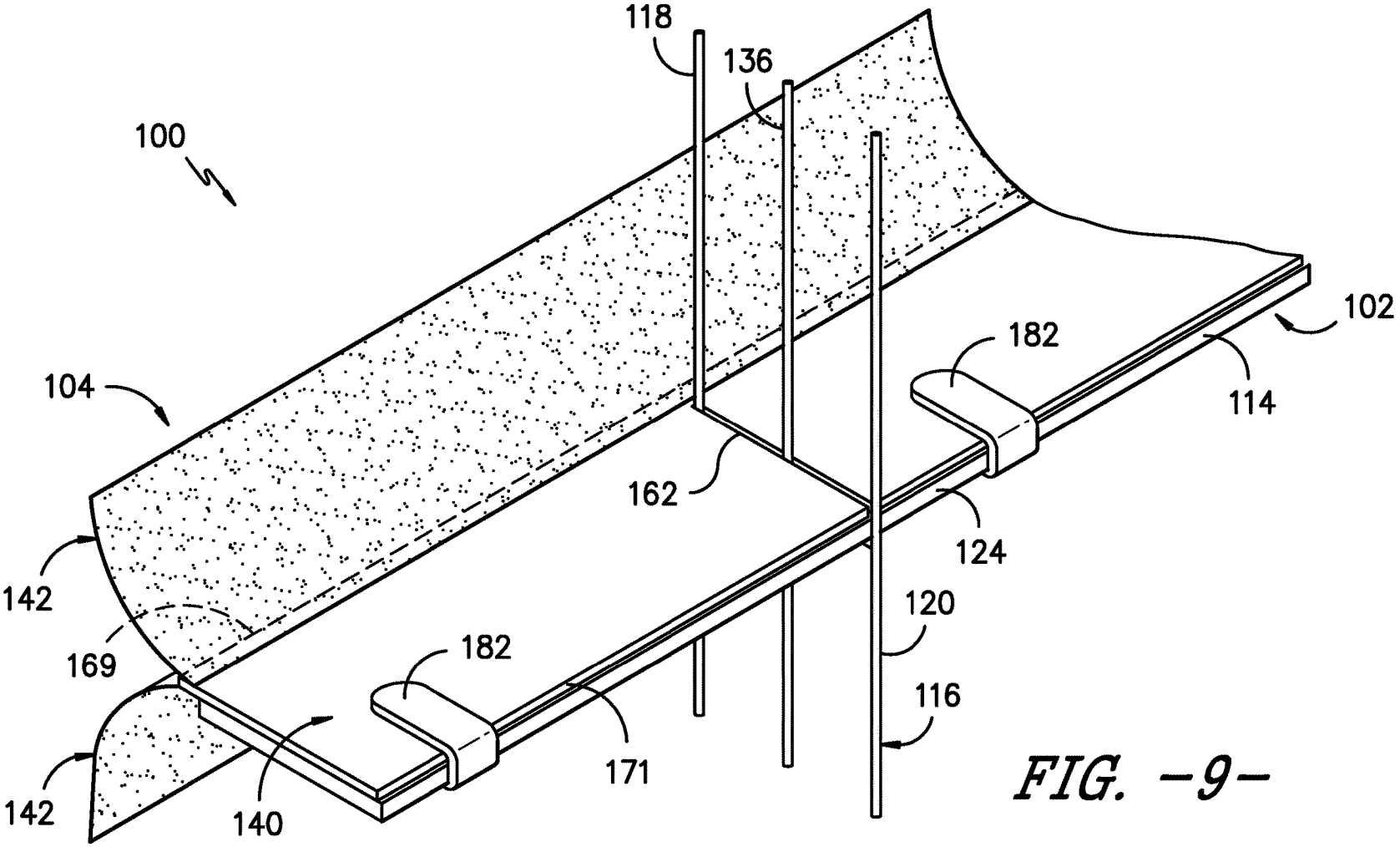
FIG. 9 illustrates a partial, rear perspective view of a further embodiment of a blind assembly in accordance with aspects of the present subject matter, particularly illustrating yet another method for attaching the shade covering to the blind.

Moreover, in further embodiments, any other suitable attachment means may be used to assist in coupling the attachment portions 140 of the shade covering 104 to the blind 102. For instance, as an alternative to the attachment slits/openings described above, each attachment portion 140 may be configured to be secured to the adjacent slat 114 over which the attachment portion 140 extends. In such an embodiment, the attachment portions 140 may be secured to the adjacent slats 114 using mechanical fasteners (e.g., clips, pins, etc.), adhesives, and/or any other suitable attachment means. For instance, FIG. 9 illustrates an embodiment in which each attachment portion 140 is secured to an adjacent slat 114 using mechanical fasteners. Specifically, as shown in FIG. 9, each attachment portion 140 may be initially positioned relative to the adjacent slat 114 by moving the attachment portion 140 relative to the slat 114 in a rearward direction such that each front ladder run 118 and/or lift cord 136 is received within a corresponding insertion slit 162. Thereafter, suitable fasteners 182 may be installed onto the slats 114 in a manner that secures each attachment portion 140 to its adjacent slat 114, such as by positioning each fastener 182 at the rear edge 108 of the slat 114 such that a portion of the fastener 182 engages and/or overlaps the rear end 171 of the attachment portion 140.

Figure 10:
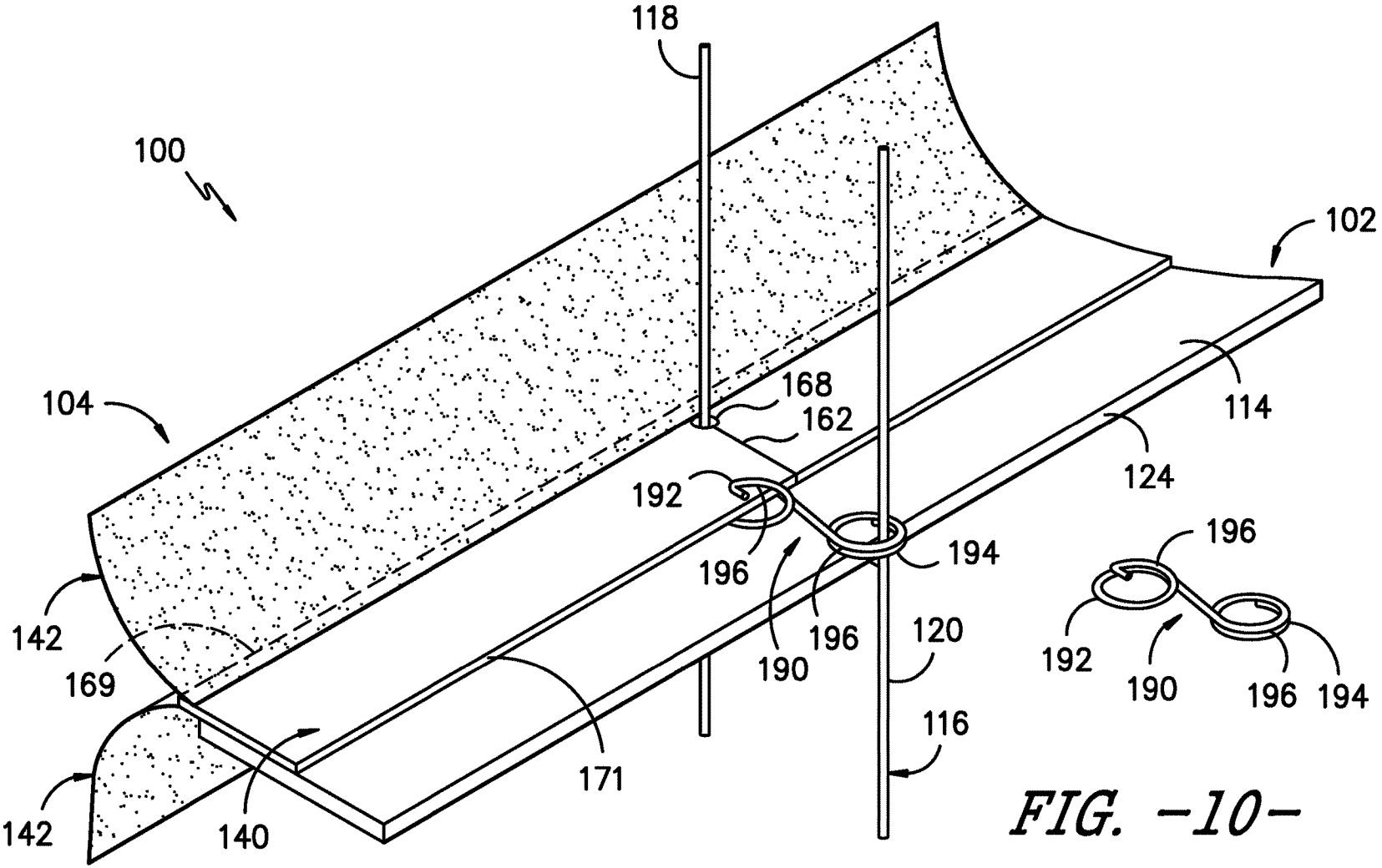
FIG. 10 illustrates a partial, rear perspective view of another embodiment of a blind assembly in accordance with aspects of the present subject matter, particularly illustrating a further method for attaching the shade covering to the blind.

In addition to using fasteners to secure each attachment portion 140 to an adjacent slat 114, or as an alternative thereto, suitable fasteners may be used to secure one or more of the ladder runs 118, 120 and/or one or more of the lift cords 136 to each attachment portion 140. For example, FIG. 10 illustrates one embodiment of a suitable fastener 190 that may be used to secure a ladder run 118, 120 and/or a lift cord 136 to one of the attachment portions 140. As shown, the fastener 190 may generally extend between a first coiled end 192 and a second coiled end 194, with a portion of each coiled end 192, 194 being wrapped or coiled over itself to create an overlapping section 196 at each end. In such an embodiment, such overlapping sections 196 may facilitate attachment of the fastener 190 between the attachment portion 140 and the corresponding run/cord. For example, as shown in FIG. 10, the rear end 171 of each attachment portion 140 may be inserted between the coiled portions forming the overlapping section 196 of the first coiled end 192 to allow the attachment portion 140 to be secured to the fastener 190. Similarly, the corresponding run/cord (e.g., the rear ladder run 120 in the embodiment shown in FIG. 10) may be inserted between the coiled portions forming the overlapping section 196 of the second coiled end 194 and subsequently wrapped around the overlapping section 196 until the run/cord is positioned within the interior of the coiled end 194 (as shown in FIG. 10).

It should be appreciated that the attachment portions 140 may be configured to have any suitable vertical spacing along the height of the blind assembly 100. For example, as shown in the illustrated embodiments, the attachment portions 140 are spaced relative to one another such that an attachment portion 140 is positioned adjacent to every third slat 114. However, in other embodiments, the attachment portions 140 may have any other suitable vertical spacing, such as by positioning an attachment portion 140 adjacent to every slat 114 or every other slat 114 or by spacing the attachment portions 140 apart by more than the three slats 114. By adjusting the spacing of the attachment portions 140, the disclosed blind assembly 100 may be provided with various different aesthetic appearances. For instance, in one embodiment, the spacing between the attachment portions 140 may be varied to provide the shade covering 100 with a semi-flat or flat appearance along the front side 106 of the blind 102. In other embodiments, the spacing between the attachment portions 140 may be varied to provide the shade covering 100 with a draped-type appearance (e.g., similar to a Roman shade).

Referring back to FIGS. 1-5, it should also be appreciated that the shade portions 142 of the disclosed shade covering 104 may generally have any suitable configuration that provides the desired look or appearance for the blind assembly 100. For instance, as shown in FIG. 4, in several embodiments, each shade portion 142 may include a lower wall segment 184 and an upper wall segment 186 extending between each pair of adjacent pair attachment portions 140, with a crease line 188 dividing the lower wall segment 184 from the upper wall segment 186. Specifically, the lower wall segment 184 may be configured to extend from the lower attachment portion 140 of the adjacent pair of attachment portions 140 to the crease line 188 and the upper wall segment 186 may be configured to extend from the crease line 188 to the upper attachment portion 140 of the adjacent pair of attachment portions 140. In such embodiments, by adjusting the respective lengths of the lower and upper wall segments 184, 186, the shape and/or appearance of the shade covering 104 may be varied significantly. For instance, in the illustrated embodiment, the lower and upper wall segments 184, 186 define substantially equal lengths such that the crease line 188 is positioned approximately halfway between the corresponding upper and lower attachment portions 140. However, by configuring the upper wall segment 186 to be significantly longer than the lower wall segment 184, the crease line 188 may, for example, be positioned closer to the lower attachment portion 140, thereby creating a drooping or overlapping profile for the shade covering 104.

It should be appreciated that the crease line 188 provided within each shade portion 142 may assist in retracting or collapsing the shade covering 104 when the associated blind 102 is moved to its retracted position. For instance, when the blind 102 is retracted, each shade portion 142 may fold/collapse relative to the crease line 188 such that the upper and lower wall segments 186, 184 are moved closer together. However, it should also be appreciated that the shade covering 104 may be configured to retract or collapse without requiring any crease lines 188. For instance, the specific material used to form each shade portion 142 may be selected such that the shade portions 142 retract/collapse when the blind 102 is moved to its retracted position.

Figure 11:
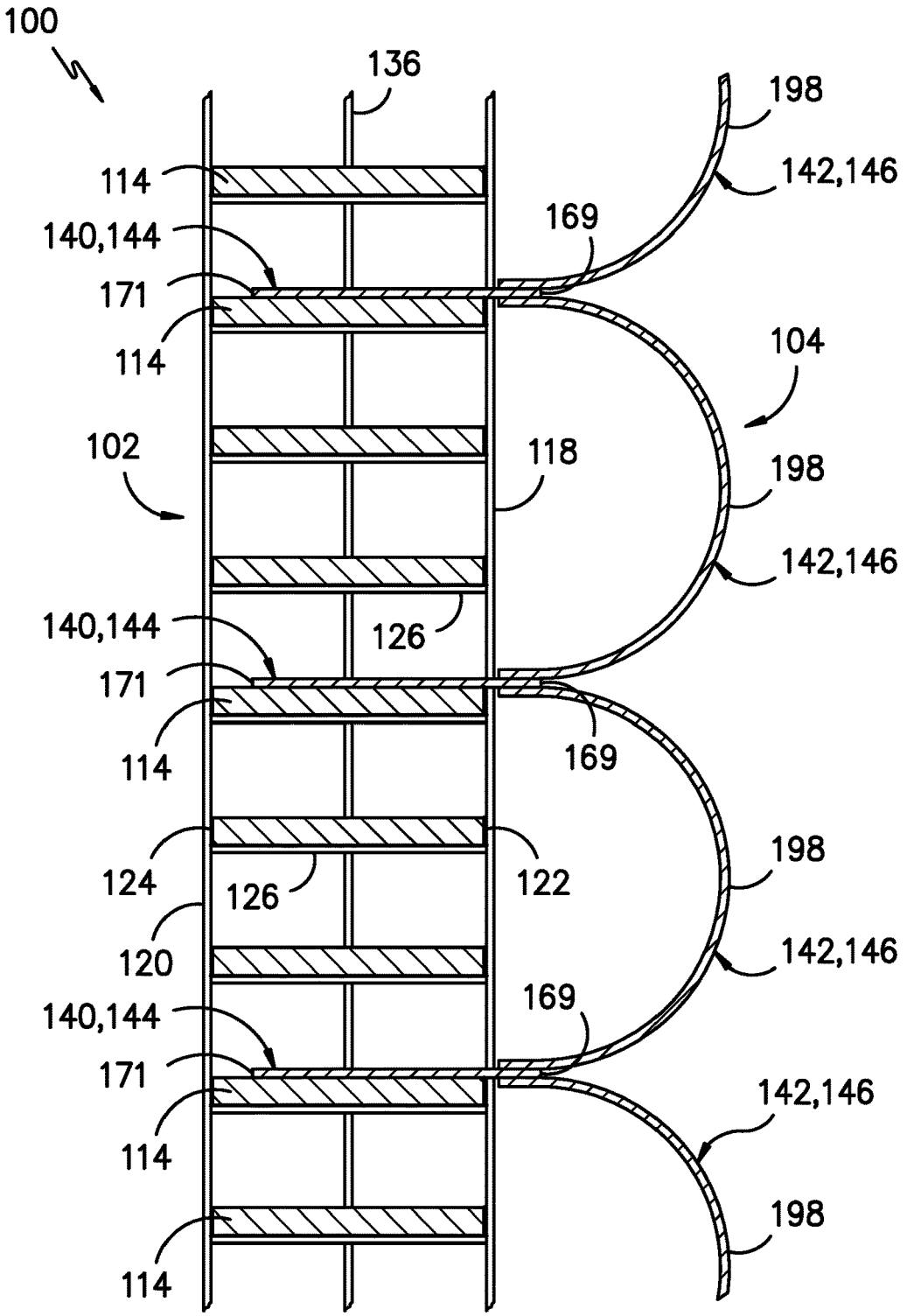
FIG. 11 illustrates a partial, cross-sectional view of yet another embodiment of a blind assembly in accordance with aspects of the present subject matter, particularly illustrating the shade covering of the assembly including non-pleated shade portions.

Additionally, as an alternative to the creased configuration shown in FIG. 4, each shade portion 142 may, instead, be configured to extend between adjacent attachment portions 140 without having a fold or crease line defined therein. For instance, FIG. 11 illustrates an alternative embodiment of the shade covering 104 shown in FIG. 4 in which each shade portion 142 includes a non-creased wall segment 198 extending between each adjacent pair of attachment portions 140. In such an embodiment, the length of the non-creased wall segment 198 may be varied, as desired, to adjust the appearance of the shade covering 104 when the blind 102 is moved to its extended position.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A blind assembly for an architectural opening, said blind assembly comprising:

a blind defining a front side and a rear side, said blind including a plurality of slats and a cord ladder configured to support said slats, each slat including a front edge positioned along said front side of said blind and a rear edge positioned along said rear side of said blind;

a separate shade covering configured to be secured to said blind such that said shade covering extends along said front side of said blind, said shade covering including a plurality of attachment portions and a plurality of shade portions, each shade portion being configured to extend between a respective adjacent pair of said attachment portions; and a plurality of fasteners, each fastener being removably coupled to a respective attachment portion and selectively coupling said respective attachment portion to a portion of said blind along the rear side of said blind.

2. The blind assembly of claim 1, wherein each fastener selectively couples said respective attachment portion to a cord ladder of said blind.

3. The blind assembly of claim 1, wherein:

said cord ladder includes a front ladder run, a rear ladder run, and a plurality of support rungs extending between said front and rear ladder runs; and each fastener selectively couples said respective attachment portion to said rear ladder run.

4. The blind assembly of claim 1, wherein each said fastener selectively couples said respective attachment portion to a respective adjacent slat of said plurality of slats at said rear edge of said respective adjacent slat.

5. The blind assembly of claim 4, wherein each said fastener is installed onto said respective adjacent slat such that said fastener overlaps a portion of a rear end of said respective attachment portion.

6. The blind assembly of claim 1, wherein:

each said fastener extends between a first coiled end of said fastener and a second coiled end of said fastener; and said respective attachment portion is coupled to one of said first coiled end or said second coiled end of said fastener.

7. The blind assembly of claim 6, wherein the other of said first coiled end or said second coiled end of said fastener is coupled to a rear ladder run of said cord ladder.

8. The blind assembly of claim 1, wherein:

each said attachment portion and each said shade portion is formed from a separate web; and each shade portion is coupled to said respective adjacent pair of said attachment portions to form a continuous covering extending vertically along said front side of said blind.

9. The blind assembly of claim 1, wherein:

said attachment portions and said shade portions are formed from a continuous web; and said continuous web forms a continuous covering extending vertically along said front side of said blind.

10. The blind assembly of claim 1, wherein each attachment portion defines an insertion slit; and said insertion slit defines an open insertion end at a rear end of each said attachment portion to allow a portion of said cord ladder to be received within said insertion slit.

11. The blind assembly of claim 10, wherein:

said cord ladder includes a front ladder run, a rear ladder run, and a plurality of support rungs extending between said front and rear ladder runs; and said shade covering is installed onto said blind by moving said shade covering relative to said blind in a direction from said front side of said blind to said rear side of said blind such that said front ladder run is received within said insertion slit at said open insertion end.

12. A blind assembly for an architectural opening, said blind assembly comprising:

a blind defining a front side and a rear side, said blind including a plurality of slats and a cord ladder configured to support said slats;

a separate shade covering configured to be secured to said blind such that said shade covering extends along said front side of said blind, said shade covering including a plurality of attachment portions and a plurality of shade portions, each shade portion being configured to extend between a respective adjacent pair of said attachment portions; and a plurality of fasteners, each fastener selectively coupling a cord of said blind to a respective attachment portion; wherein each fastener is coupled to said cord at a location spaced apart from said respective attachment portion.

13. The blind assembly of claim 12, wherein said cord comprises a ladder run of said cord ladder.

14. The blind assembly of claim 13, wherein said ladder run comprises a front ladder run or a rear ladder run of said cord ladder.

15. The blind assembly of claim 12, wherein said cord comprises a lift cord of said blind.

16. The blind assembly of claim 12, wherein:

each said fastener extends between a first coiled end of said fastener and a second coiled end of said fastener;

said respective attachment portion is coupled to one of said first coiled end or said second coiled end of said fastener; and said cord is coupled to the other of said first coiled end or said second coiled end of said fastener.

17. The blind assembly of claim 12, wherein:

each said attachment portion and each said shade portion is formed from a separate web; and each shade portion is coupled to said respective adjacent pair of said attachment portions to form a continuous covering extending vertically along said front side of said blind.

18. The blind assembly of claim 12, wherein:

said attachment portions and said shade portions are formed from a continuous web; and said continuous web forms a continuous covering extending vertically along said front side of said blind.

19. The blind assembly of claim 12, wherein each attachment portion defines an insertion slit; and said insertion slit defines an open insertion end at a rear end of each said attachment portion to allow a portion of said cord ladder to be received within said insertion slit.

20. The blind assembly of claim 19, wherein:

said cord ladder includes a front ladder run, a rear ladder run, and a plurality of support rungs extending between said front and rear ladder runs; and said shade covering is installed onto said blind by moving said shade coveting relative to said blind in a direction from said front side of said blind to said rear side of said blind such that said front ladder run is received within said insertion slit at said open insertion end.

21. A blind assembly for an architectural opening, said blind assembly comprising:

a blind defining a front side and a rear side, said blind including a plurality of slats and a cord ladder configured to support said slats;

a separate shade covering configured to be secured to said blind such that said shade covering extends along said front side of said blind, said shade covering including a plurality of attachment portions and a plurality of shade portions, each attachment portion defining an insertion slit, said insertion slit configured to allow a portion of said cord ladder to be received within said insertion slit, each shade portion being configured to extend between a respective adjacent pair of said attachment portions; and a plurality of fasteners, each fastener selectively coupling a cord of said blind to a respective attachment portion at a location spaced apart from said insertion slot.

22. The blind assembly of claim 21, wherein said cord comprises a ladder run of said cord ladder or a lift cord of said blind.

23. The blind assembly of claim 22, wherein:

said cord comprises said ladder run; and said ladder run comprises a front ladder run or a rear ladder run of said cord ladder.

24. The blind assembly of claim 21, wherein:

said cord ladder includes a front ladder run, a rear ladder run, and a plurality of support rungs extending between said front and rear ladder runs; and said shade covering is installed onto said blind by moving said shade covering relative to said blind in a direction from said front side of said blind to said rear side of said blind such that said front ladder run is received within said insertion slit at said open insertion end.

* * * * *